United States Patent [19]

Chen et al.

[11] Patent Number: 4,883,564

[45] Date of Patent: Nov. 28, 1989

[54] CREPING DEVICE ADHESIVE FORMULATION

[75] Inventors: Patrick P. Chen, Sewell, N.J.; Taiwoo Chiu, Springfield; J. Richard Skerrett, Bala Cynwyd, both of Pa.

[73] Assignee: Scott Paper Company, Philadelphia, Pa.

[21] Appl. No.: 201,496

[22] Filed: Jun. 1, 1988

[51] Int. Cl.[4] ..... D21H 5/24

[52] U.S. Cl. ..... 162/112; 162/113; 162/111; 264/282; 264/283; 156/183; 156/327

[58] Field of Search ..... 162/111, 112, 113; 156/183, 327; 264/282, 283; 524/416, 417

[56] References Cited

U.S. PATENT DOCUMENTS 4,543,128 9/1985 Troesch et al. ..... 8/625 X 4,559,103 12/1985 Nomura et al. ..... 162/160

*Primary Examiner*—Peter Chin

*Assistant Examiner*—Thi Dang

*Attorney, Agent, or Firm*—John A. Weygandt; John W. Kane, Jr.

[57] ABSTRACT

Addition of a phosphate salt to creping adhesive composition comprising a water soluble binder increases operational efficiency.

3 Claims, No Drawings

CREPING DEVICE ADHESIVE FORMULATION

BACKGROUND OF THE INVENTION

1. Field of the Invention

This invention relates to the manufacture of soft, absorbent tissue paper webs and particularly to formulations for creping such webs to obtain improved softness in the web while increasing operational efficiency.

2. Description of the Related Art

The creping of paper webs by removing them from a heated surface, usually a rotating drum, with a doctor blade to impart softness to the web is well known in the art. The benefits and difficulties encountered in such a process have been extensively discussed in the prior art, notably, Grossman, U.S. Pat. No. 4,063,995, issued Dec. 20, 1977. The creping process depends upon controlling the adhesion of the web to the heated surface. Many adhesive formulations have heretofore been proposed. The present invention relates to creping adhesives which are applied to the creping drum, and more particularly to formulations comprising a water-soluble adhesive. See for example Grube et al, U.S. Pat. No. 4,304,625, issued Dec. 8, 1981, wherein the water soluble component is polyvinyl alcohol. The creping adhesive tends to coat the dryer with a hard and uneven film which builds up as drying and creping proceed, resulting in uneven creping and rapid wear of the creping blade itself. See Grube et al at Col. 2, lines 25–30. In many cases, a cleaning blade is used to scrape the film from the drum surface. These cleaning blades must be changed frequently. Additionally, they cause creping surface wear.

SUMMARY OF THE INVENTION

The present inventors have found that the addition of a phosphate salt to the creping adhesive formulation greatly reduces the problem of the hard film build-up on the creping surface. As a result, the creping and cleaning blades need to be changed less often and the creping is more even. The additive of the present invention has utility over the entire moisture range in creping process. The web, as it approaches the creping surface, can be taken directly from the fordrinier or forming section where it is as "wet" as containing 60–70% water, or it may be as "dry" as having only 3% moisture. Correspondingly, the invention pertains to processes where the web, as it leaves the creping surface, contains as much as 35% water to as little as 3%.

In general, a potassium phosphate is preferred for use in accordance with the present invention because of its greater solubility. However, if the mill water is "hard" a potassium polyphosphate solution is preferred as it does not precipitate out as readily because of its sequestering power. Such solutions are mixtures of ortho, pyro, tripoly and other higher poly phosphates and $K_2O$. They are typically sold as proprietary formulations. The potassium polyphosphate solution employed in the examples which follow was Kalipol E-19 sold by ERCO Industries Limited, 2 Gibbs Road, Islington, Ontario M9B 1R1 Canada.

In accordance with the present invention, the phosphate salt is incorporated into the creping adhesive in an amount from 1–15% by weight of the solids content of the adhesive. As mentioned, the adhesive composition is characterized in comprising a water soluble binder. As may be seen from Example II which follows, the adhesive component may be 100% water soluble binder.

DESCRIPTION OF THE PREFERRED EMBODIMENTS

The principles, features and advantages of the invention will be further understood upon consideration of the following specific examples.

EXAMPLE I

A web was formed using a pulp furnish of 70% northern softwood kraft and 30% eucalyptus on a conventional paper machine. The web was formed on a twin wire former and partially dried to a dryness of 75% (25% water by weight) prior to the Yankee section. The web was pressed onto the Yankee cylinder using a pressure roll on which the loading was 200 pounds per linear inch.

The Yankee creping cylinder, having a diameter of 15 feet, was coated with a polymer film that provides adhesion between the sheet and the cylinder surface. The polymer material was applied to the cylinder as an aqueous dispersion containing 5% (by weight) polymer solids by means of spraying. The polymer solids was a mixture of 49% (by weight of total solids) high molecular weight (750,000) polyvinyl acetate having a glass transition temperature (Tg) of 27° C.; and 49% low molecular weight polyvinyl alcohol and 2% of potassium polyphosphate. The spraying means applied 0.13 grams per square meter of cylinder surface. The creping cylinder was heated using saturated steam at 100 psi and the supply of hot air to the hood above the Yankee cylinder was maintained at 450° F. The Yankee cylinder speed was 3225 feet per minute. The polymer film formed on the dryer at the press roll nip had been heated to a "molten" like visco-elastic state. As the web was pressed onto the cylinder, its average water content was 25%. After the sheet is pressed onto the cylinder it remained in contact with the heated cylinder, reaching a temperature of 260° F. just prior to arrival at the crepe blade. The crepe blade is set such that the creping angle is 15° above the radial line at the point of contact. The creped sheet had a dryness of 96.8% (3.2% moisture) when it came of the creping blade. This creped sheet was calendered to meet the desired bulk specification prior to the reel. The Yankee speed and reel speed was set in such a way that there is a formation of 8% crepe. The web is converted and then rewound into small rolls for cnsumer use. The physical properties are listed in the following table.

| | |
|---|---|
| B.W. | 17.1 lbs/2880 $ft^2$ (Conditioned Weight) |
| Bulk | 240 in/24 sheet (after calendaring) |
| | 310 in/24 sheet (before calendaring) |
| MDT | 17.7 oz/in |
| CDT | 7.0 oz/in |
| MDS | 20% |
| CDS | 11% |

Including potassium polyphosphate in the Yankee spray chemical system as above described provided a means of coating film control in terms of uniformity and adequate elasticity which allows the adhesion development and commercially feasible creping blade life. During the crepe blade life time of more than six hours, it maintained acceptable crepe and smoothness in the creped sheet.

A similar one-ply product was made on the same paper machine with the same process conditions except the spray chemical fluid on the Yankee cylinder did not contain a phosphate salt. A mixture of 50% of high molecular weight polyvinyl acetate (Tg=27° C.) and 50% of low molecular weight polyvinyl alcohol was sprayed onto the Yankee cylinder through the same spray configuration. The dryer cylinder coating became uneven (streaked) within 15 minutes of operation. The creped web was full of holes and eventually broke out at the creping blade due to sheet plugging. The Yankee creping blade had to be changed more frequently to maintain coating control. The average creping blade life was 1 hour.

The addition of potassium polyphosphate in the Yankee spray chemical system improved the process in terms of Yankee coating and production stability.

EXAMPLE II

A web was formed on a conventional fourdrinier papermaking machine using pulps composed of 60% southern softwood kraft, 20% eucalyptus and 20% secondary fiber.

The web was dried on a Yankee cylinder to a dryness of 97% (3% moisture) and removed from the Yankee using a creping doctor blade. A paper web was formed having 6% crepe by controlling the speed differential between the Yankee and a second creping cylinder. The adhesive used on the Yankee was a low Tg polyamine applied at a rate of 0.015 grams per square meter of the Yankee surface.

Web properties after the Yankee were as follows:

| | |
|---|---|
| BW | 14.5 lb/2880 ft$^2$ |
| Bulk | 0.135 in/24 sheets |
| MDT | 18.8 oz/in |
| CDT | 9.4 oz/in |
| MDS | 12.0% |

The web was then pressed onto a creping cylinder which had a diameter of five feet. The surface of the cylinder was coated with a creping adhesive composite in the form of a polymer film that provides the adhesion between the sheet and the dryer surface. The polymer film material was applied to the cylinder as an aqueous dispersion containing 6.5% polymer solids by means of spraying. The polymer solids comprised a mixture of the following components:

a. 65% High molecular weight polyvinyl acetate with a Tg=32° C.
b. 20% low molecular weight polyvinyl alcohol
c. 5% sugar (sucrose)
d. 10% potassium polyphosphate The spray means applied 0.16 grams per square meter of creping cylinder surface. The creping cylinder was heated with saturated steam at 90 pounds per square inch guage. The cylinder surface speed was 2750 feet per minute. As the web was pressed onto the cylinder, the average moisture content of the web was 5%.

After the web is pressed onto the cylinder, which is coated with the polymer film, the web and film are heated by the cylinder to 132° C. just prior to their reaching the creping blade. The creping blade is set such that the creping angle is 4° above the cylinder radial line at the point of contact. The creped sheet issuing from the creping cylinder was wound at a speed of 2600 fpm resulting in the formation of 8% crepe in the second creping step. The physical properties of the resultant creped paper web are given in the following table:

| | |
|---|---|
| BW | 16.9 lbs/2880 ft$^2$ |
| Bulk | 0.225 in/24 sheet |
| MDT | 10.2 oz/in |
| CDT | 5.4 oz/in |
| MDS | 22% |

A similar one-ply product using the same furnish was made on the same paper machine without the invention, using the creping adhesive consisting of:

a. 75% high molecular weight polyvinyl acetate
b. 20% low molecular weight polyvinyl alcohol
c. 5% sugar (sucrose)

The rewound one-ply product had the following physical properties:

| | |
|---|---|
| BW | 16.8 lbs/2880 ft$^2$ |
| Bulk | 0.195 in/24 sheet |
| MDT | 12.0 oz/in |
| CDT | 4.8 oz/in |
| MDS | 20% |

The invention greatly improved the second step creping cylinder coating control in terms of blade life. The average life of the creping blade was 3 hours more than that without the use of the present invention.

EXAMPLE III

This example illustrates the importance of the use of a phosphate salt in accordance with the present invention in terms of process control in wet crepe production of tissue.

A web was formed with pulps composed of 50% slush pine, 25% machine broke, 20% bleached broke, and 5% hardwood pulp on a conventional fourdrinier machine having a Yankee dryer.

The web was pressed to the Yankee at 17% dryness (83% water) with a suction pressure roll at a loading of 850 pounds per square inch gauge and then pressed again with a second roll at a pressure of 585 pounds per square inch gauge. As will be appreciated by one of ordinary skill in the art, in a wet crepe process such as illustrated in the present example, the Yankee drum is serving to effect substantial drying as well as providing a creping surface. While it is difficult to measure exactly the moisture content of the web after the second pressure roll, the present inventors estimate it to have been about 60-70% at that point. The adhesive material was sprayed onto the cylinder at a point before the first pressure roll as an aqueous dispersion containing 4% solids. The adhesive material comprised a mixture of 96% (by weight of total solids) release/softening agent comprising approximately 60% dimethyl diallyl ($C_{12}$-$C_{16}$) amine chloride, 35% polyethylene glycol ester (M.W. about 600), 5% isopropanol and 5% of a nonionic surfactant and 4% of monoammonium phosphate. The spray means applied the chemicals at the rate of 20.6 milligrams per square meter. The Yankee cylinder was run at a speed of 2790 fpm and heated with 90 pounds per square inch gauge saturated steam. The sheet was then creped from the cylinder using a creping blade set at a creping angle of 2° above the radial line at the creping cylinder contact point. The sheet was creped off the Yankee cylinder at a dryness of 71.5% (28.5% moisture) and continuously dried through the after dryer cans. The sheet was then calendered to a specific bulk requirement prior to being wound upon a reel with sheet dryness at 97% (3% moisture).

The application of 4% monoammoniumphosphate in the spray chemical system enhanced the coating control resulting in a smoother creping operation. The sheet did not plug at the creping blade and the creping blade life could be more than 10 hours while maintaining the sheet quality. The operation without the monoammoniumphosphate in the spray chemical system caused the deterioration of the coating film on the dryer surface resulting in sheet plugging on the creping blade and requiring the blade to be changed every hour.

The physical properties of this one-ply tissue were:

| | |
|---|---|
| BW | 25.9 lbs/2880 $ft^2$ |
| Bulk | 0.131 in/24 sheet |
| MDT | 87 oz/in |
| CDT | 44 oz/in |
| MDS | 5.4% |
| CDS | 2.5% |

-continued

| | |
|---|---|
| MDWT | 25.2 oz/in |

Although the invention has been described with reference to preferred embodiments thereof, it is to be understood that various changes may be resorted to by one skilled in the art without departing from the spirit and scope of the invention as defined by the appended claims.

What is claimed is:

1. In a process of treating a paper web by applying an adhesive composition to a creping surface and creping the web from said surface, the improvement which consists of employing an adhesive composition comprising a water soluble binder and a phosphate salt present in an amount from 1–15% by weight of the solids content of the adhesive.

2. The process in accordance with claim 1 wherein the water soluble binder is polyvinyl alcohol.

3. The process in accordance with claim 1 wherein the phosphate salt is a polyphosphate.

* * * * *